United States Patent [19]

Collins

[11] 3,998,008

[45] Dec. 21, 1976

[54] TURNSTILE HEAD MECHANISM CONSTRUCTION

[75] Inventor: Terence J. Collins, Schaumburg, Ill.

[73] Assignee: Qonaar Corporation, Elk Grove Village, Ill.

[22] Filed: Apr. 30, 1975

[21] Appl. No.: 572,962

[52] U.S. Cl. ..... 49/47

[51] Int. Cl.[2] ..... E06B 11/08

[58] Field of Search ..... 49/46, 47; 188/82.7

[56] References Cited

UNITED STATES PATENTS

| | | | |
|---|---|---|---|
| 2,054,701 | 9/1936 | Kennedy | 49/47 |
| 3,795,075 | 3/1974 | Orzechowski | 49/46 |

FOREIGN PATENTS OR APPLICATIONS

| | | | |
|---|---|---|---|
| 1,264,468 | 2/1972 | United Kingdom | 49/46 |

*Primary Examiner*—Kenneth Downey
*Attorney, Agent, or Firm*—McDougall, Hersh & Scott

[57] ABSTRACT

A turnstile construction wherein arms normally block the path of movement of persons passing through the turnstile. The arms are engaged when authorized passage is available, and this results in movement of the arms either by the force of the person passing through or in a motor-assisted fashion. The head supporting the arms includes a control system including a drive gear tied to the arms for rotation during movement of the arms. Rotatable locking members are connected to the drive gear, and engaging arms are movable into and out of engagement with the locking members for purposes of controlling use of the turnstile. The engaging arms are normally controlled by the deposit of a proper fare whereby in the course of normal use, only persons paying a fare can pass through the turnstile. When locked, the system automatically protects against breakaway even when an extreme load is applied. A governor is included in the system in a fashion such that bi-directional speed control is automatically provided in all modes of use. The construction is designed for controlling the direction through which persons may pass; it can be efficiently set for free-wheeling in one direction, but will lock automatically in a position so that improper use by partial movement of the turnstile arms is prevented. Also included is an automatic disengaging function to permit passage in both directions during emergencies and other circumstances where fares are not to be collected.

27 Claims, 15 Drawing Figures

FIG. 5
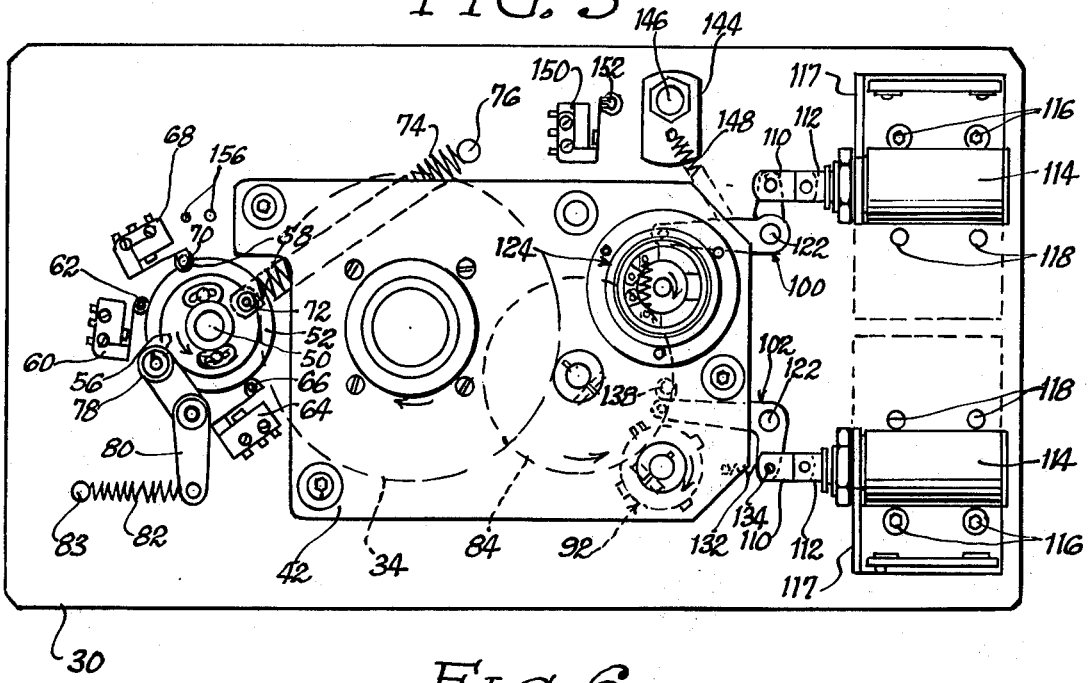
FIG. 6
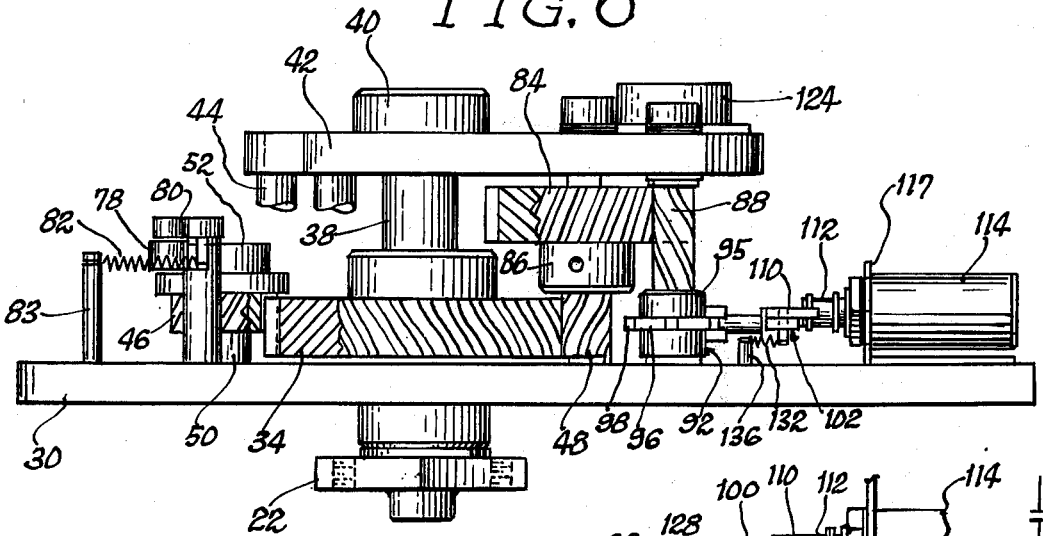
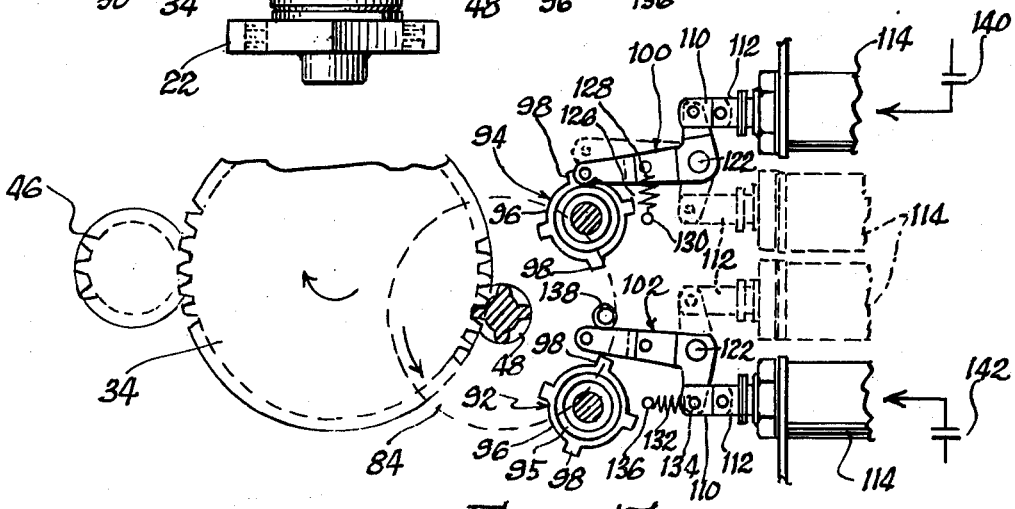
FIG. 7

TURNSTILE HEAD MECHANISM CONSTRUCTION

This invention relates to a turnstile construction. The invention is particularly concerned with turnstiles of the type employed in conjunction with the collecting of a fare so that only authorized use of the turnstile is permitted under normal circumstances. Such turnstiles may be ued for transit systems, for entry into stadiums or other entertainment areas, and for a variety of other purposes.

In making reference to a "fare", it is intended that fares of various types may be employed. Thus, the deposit of coins or bills is contemplated along with the deposit or insertion of tickets or cards which may be issued for use in lieu of money.

In a typical turnstile design, arms are supported on a head, and the head rotates when the arms are pushed by a person desiring to pass through the turnstile. In some instanes, the head movement is motorized whereby the person moving through the turnstile may provide only part of the driving force of the arms.

In order to control passage through a turnstile, various locking means have been developed. These locking means may normaly prevent movement in both directions or may prevent movement in only one direction while being freewheeling in the other direction. Where movement in one or both directions is controlled, the presentation of a fare will permit a person to pass through the turnstile. The unlocking of the turnstile for the person may be accomplished manually by an attendant or automatically if a fare receiving means with automatic head mechanism control is available.

In developing structures which accomplish the above noted aims, various problems have been encountered. In some mechanisms, the placing of an undue load on an arm as when someone leans heavily on the arm, has been known to jam the system. Similarly, the application of a sudden load, for example if someone attempts to run through the turnstile, can lead to jamming or other undesirable disruption in the operation.

Other problems have developed in attempting to "cheat" the system, for example, where a person tries to pass through by pulling an arm partially toward himself, that is, by pulling an arm in the "free-wheeling" direction. In prior systems, this has enabled individuals to provide enough room for passing through, particularly since the arm, when pulled forward, will still move back as the person passes through. Attempts to solve these and similar problems have led to relatively complex and expensive designs so that completely practical systems have not been available.

It is a general object of this invention to provide an improved turnstile construction.

It is a more specific object of this invention to provide a turnstile construction which includes an improved head mechanism whereby the turnstile operation can be conducted in a highly efficient manner without the necessity for highly complex mechanial or electircal comonents.

It is a still further object of this invention to provide a head mechaism for a turnstile construction which is characterized by extreme versatility whereby the turnstile operation can be varied to accommodate a variety of different operational modes.

These and other objects of this invention will appear hereinafter and for purposes of illustration but not of limitation, specific embodiments of the invention are shown in the accompanying drawings in which: FIG. 1 is a side elevation of a turnstile construction;

FIG. 5 is a rear elevational view of a supporting plate utilized in the construction for supporting the various control mechanisms;

FIG. 6 is a top view of the control mechanisms and associated supporting plate;

FIG. 7 is a fragmentary, detailed view illustrating various elements of the control mechanism;

Figure 1:
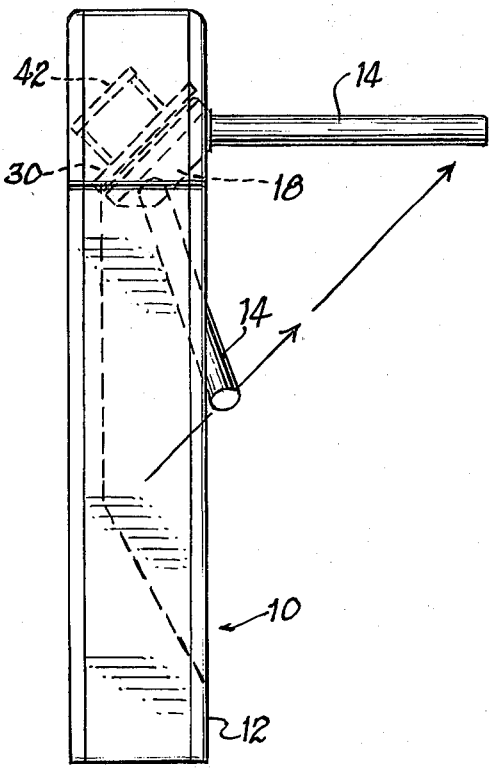

The turnstile construction of the invention comprises a construction of the type wherein an arm means blocks the path of movement of persons desiring to pass through the turnstile. These arm means are adapted to be engaged by such persons and are movable out of blocking position as the persons pass through. Control means including means for locking and unlocking the arm means are employed so that only authorized use of the construction is permitted.

The subject matter of this invention relates in particular to the control means for a turnstile of the type described. In accordance with this invention, the control means comprises a drive gear which is tied to the arm means for movement therewith. First and second rotatable locking means are operatively connected to the drive gear, and engaging means are provided for each locking means. Actuating means are associated with the respective engaging means, and means are provided for normally holding at least one engaging means in engagement with a locking means. When a fare as described above is received by the construction, the engaging means operate to disengage the locking means whereby the arm means are free for movement.

The construction of the invention utilizes crank arms which are employed as the engaging means for the rotatable locking means. These crank arms are preferably pivotally driven by solenoids or other electrically powered means. The deposit of a fare or some other condition can then serve to operate the solenoids for purposes of moving the respective crank arms to develop a condition such that the turnstile means will permit the passage of individuals.

As will be more specifically explained, the use of locking means of the type described results in a system characterized by identically operating, bi-directional, speed control means. The system is also completely resistant to any break-away under load as when an individual leans heavily on an arm or attempts to run through the system. The locking means are also characterized by an immediate lock-up when moved in the free-wheeling direction so that it is not possible to return an arm once movement in that direction begins. The structure of the locking means does provide, however, that the arm will be unlocked upon the deposit of a fare even if the fare is deposited with the arm partially moved in the free-wheeling direction. This distinguishes from prior art arrangements which required that the arm be in its normal position before it could be unlocked by a fare deposit. If an individual deposited a fare with the arm out of position, the fare would be lost in many instances, and the turnstile would be inoperative until someone moved an arm to a normal blocking position.

The provision of the crank arms is particularly important for purposes of providing unique versatility in the construction. Thus, the invention contemplates a mounting arrangement whereby the positions of the solenoids and associated crank arms can be changed for purposes of varying the particular turnstile operation. Thus, the invention contemplates a structure which can be initially set up to accommodate any particular operation, for example, any direction of normal movement. This set-up can then be changed whenever the operators wish to change the operating direction, for example, if a change from two controlled directions to one, or vice versa, is desired.

The invention further contemplates the provision of a swtich actuating wheel structure which is operated by the aforementiond drive gear. This arrangement provides for positive control of electrical elements utilized in the construction along with accurate synchronization of the mechanical and electrical functions. The switches employed are also adapted to be physically relocated in a highly efficient manner when certain changes in operating modes are desired.

The construction of the invention is also characterized by the use of a speed governor whereby arm movements are carefully controlled. This speed governor is influenced by the drive movement imparted to the arms when the turnstile is in use. The gearing which characterizes the construction is such that the head mechanism supporting the arms reaches a maximum allowable speed which is just above the speed desired for normal operation. In the event that any attempt is made to move the turnstile arms too rapidly, the speed governor automatically comes into play. This provides a desirable operating feature both from the standpoint of operating efficiency and with respect to the control of crowd movement.

The construction illustrated in the accompanying drawings comprises a turnstile 10 including a stanchion 12. This stanchion supports arm means consisting of three arms 14, one of which extends into the path of movement of a person desiring to pass through the turnstile. In accordance with conventional operation, a person passing through will move the one arm through 120° with the next arm then being moved to the blocking position.

Figure 4:
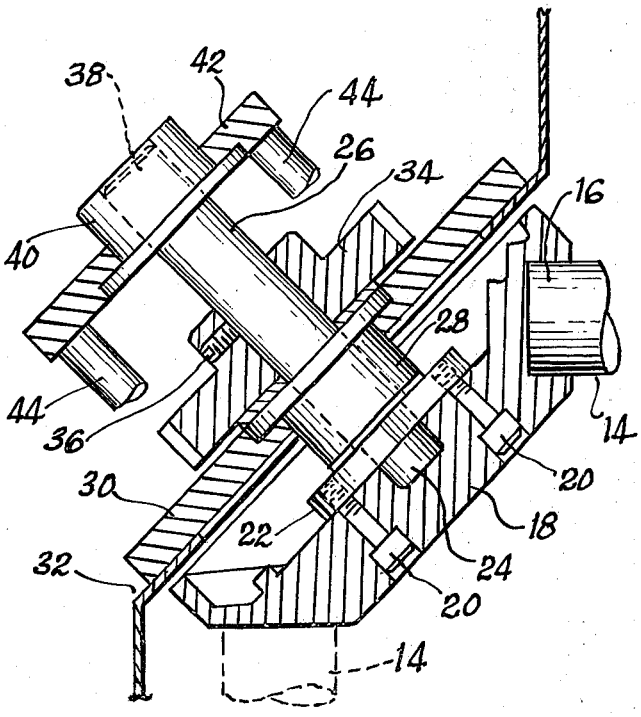
FIG. 4 is an enlarged vertical, sectional view taken about the line 4—4 of FIG. 2.

As best shown in FIG. 4, the ends 16 of the arms 14 are tightly secured to a disc support 18. This support is mounted by means of bolts 20 onto a plate 22. The end 24 of shaft 26 is received within the support 18 and within an opening in the plate 22. The shaft end and opening are preferably non-circular so that the shaft 26 is fixed for movement with the support 18.

The shaft 26 moves within the bearing housing 28 which is supported on control support plate 30. This plate is attached by fasteners (not shown) to the wall 32 of stanchion 12. Accordingly, the shaft 26 is rotated relative to the plate 30 and housing wall whenever an arm 14 is moved from a blocking position during passage of an individual through the turnstile.

A drive gear 34 is secured by means of set screw 36 for rotation with the shaft 26. The opposite end 38 of the shaft 26 is received within bearing support 40, and this bearing is fastened to plate 42. The plate 42 is fixed in spaced relationship relative to the plate 30 by means of posts 44.

As best shown in FIGS. 5–7, the drive gear 34 meshes with a first driven gear 46 and a second driven gear 48. The gear 46 is fixed to a supporting shaft 50 which also carries a switch actuating wheel 52. As best shown in FIG. 5, the wheel 52 comprises a stepped wheel defining one notach 56 in its upper section and a second notch 58 in its lower section.

A plurality of switches are located around the wheel 52. These switches include a first switch 60 which is normally closed, and caused to open when the notch 58 encounters the end of the switch arm 62. This takes place after 45° of rotation of the wheel 52 as will be more fully explained.

A second switch 64 is positioned so that the arm 66 thereof is encountered by the notch 58 after about 180°of movement of the wheel 52. This switch 64 is also normally closed and is opened when encountered by the notch 58.

A third swicth 68 is provided with an actuating arm 70 with the arm 70 being located within the notch 58 when the wheel 52 is at the position occupied when an arm 14 is in the blocking position. When the wheel 52 rotates as an arm 14 moves, the switch 68 is closed, and it remains closed until the wheel 52 makes one complete revoltuion. The switch arm 70 is then encountered by the notch 58 which results in opening of the switch 68.

The wheel 52 supports a post 72 to which is connected one end of spring 74. A second post 76 is supported on the plate 30, and the spring 74 is, therefore, held under increased tension during initial movement of the wheel 52 from the position shown. After 60° of arm movement, the spring 74 applies driving force to the wheel 52 insuring movement of the wheel through one revolution. The tension in the spring is at a minimum in the position shown, and the spring, therefore, seeks return of the wheel to the starting position.

The notch 56 defined by the wheel receives the end 78 of crank arm 80 when the construction is in the position illustrated. A spring 82 attached to post 83 normally urges the end 78 of the crank arm against the wheel 52. Accordingly, the spring 82 pulls the crank arm to the position shown at the end of a revolution of the wheel 52 which, therefore, provides a centering function.

The second drive gear 48 which is engaged with the main drive gear 34 has its ends journalled in the respective plates 30 and 42 in any conventional fashion. The shaft of this gear supports a gear 84 which is preferably connected to the shaft by means of a set screw received by the gear hub 86. The gear 84 is in driving engagement with a pair of evoloid gears, one of which comprises the gear 88 shown in FIG. 6.

The evoloid gears are also journalled in the plates 30 and 34. The gear 88 has a first locking means 92 associated therewith, and the other gear is associated with a corresponding locking means 94. Each locking means includes a cylindrical portion 95 which comprises the outer race of a conventional one-way clutch assembly.

A ring 96 is tied to each cylindrical portion, and each ring 96 is provided with teeth 98 portioned at 90 °intervals on the respective rings.

Figure 8:
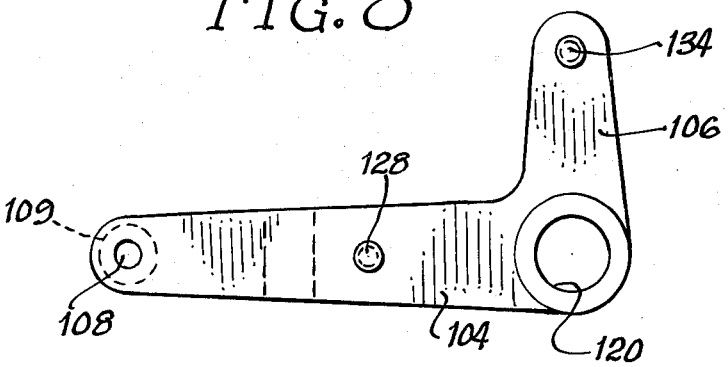
FIG. 8 is a plan view of a crank arm construction utilized as part of the conrol mechanism.
Figure 9:
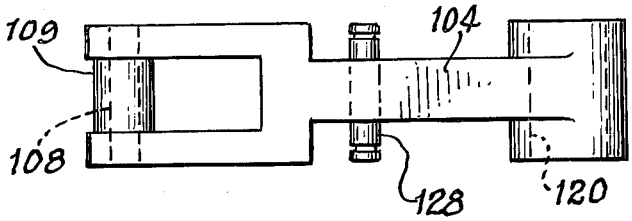
FIG. 9 is a side elevaton of the crank arm construction.
Figure 10:
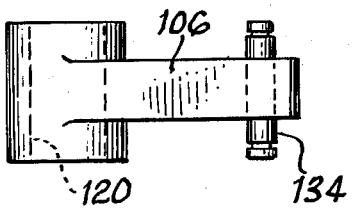
FIG. 10 is an end elevation of the crank arm construction.
Figure 11:
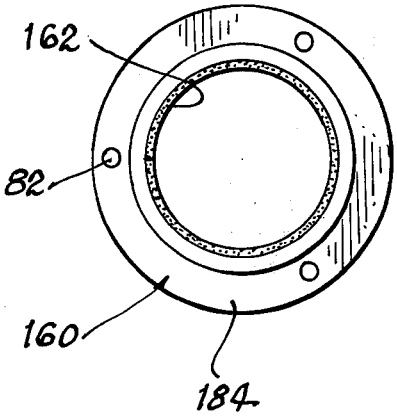
FIG. 11 is a plan view of a housing utilized for a speed governor employed in the system.

The locking means including the rings 96 and teeth 98 are utilized in conjunction with crank arms 100 and 102. Each of these arms, as best shown in FIGS. 8–10, includes an operating arm 102 and a short drive arm 106. A pin 108 is supported at the ends of the crank arms, and a wheel 109 on the pin is adapted to engage teeth 98. Thus, the crank arms are adapted to be pivoted into the path of movement of the teeth, and these arms then prevent continued movement of the locking means engaged.

Each of the arms is connected by means of a link 110 to the core 112 of a solenoid 114. The solenoids 114 are held on the plate 30 by means of bolts 116 which extend through the plate. Brackets 117 are designed for supporting the solenoids, and these brackets are adapted to be repositioned when the bolts 116 are removed. Thus, openings 118 are defined by the plate, and these openings provide alternate means for location of the solenoids 114. As will be more fully developed, this provides an alternative mode of operation for the solenoids and associated crank arms which lends considerable versatility to the operation of the construction.

The crank arms 100 and 102 define openings 120 at their corners whereby the arms can be pivotally supported on posts 122 carried by the plate 30. As best illustrated in FIG. 7, these same posts may be utilized for the crank arms when they are repositioned so that the drive arms 106 thereof assume the dotted line position shown in FIG. 7. In this position, the solenoids 114 are moved inwardly and the arms 106 are then connected to the solenoid cores 112 in the same manner as shown in the solid line position.

The gear design illustrated is a so-called evoloid design which provides a particularly smooth operation. In a typical embodiment, the main drive gear 34 will have 42 teeth and the gear 46 will have 14 teeth. Accordingly, the passage of one person will move the gear 34 through 120° which will result in one revolution of the gear 46 and the associated switch control wheel 52.

In this embodiment, the gear 34 will rotate the gear 48 through 3½ revolutions during each movement of a person through the turnstile, and the gear 84 may be provided with 38 teeth thereby imparting rapid rotation (33¼ revolutions) to the gear 88 during each turnstile usage. A centrifugal brake 124 is associated with at least one of the gears 88 to provide unduly raid movement through the turnstile. Thus, the brake acts as a speed governor to limit the rotation of a gear 88 to a maximum speed which in turn limits the maximum speed of the turnstile arms. A person moving through the turnstile will thus encounter resistance of the arms if an attempt is made to run through. This insures efficient operation of the control elements.

The particular speed governor design is shown in FIGS. 11 through 15. The design includes a brake drum section 160 carrying a liner 162 formed of a suitable material having a relatively high coefficient of friction and long life.

Figure 12:
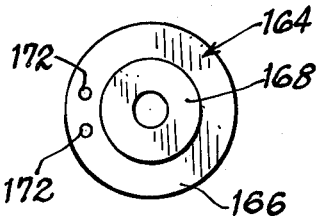
FIG. 12 is a plan view of a brake hub utilized in association with the governor.
Figure 13:
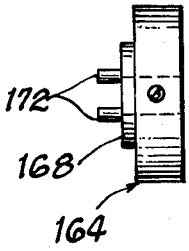
FIG. 13 is a side elevational view of the brake hub.
Figure 14:
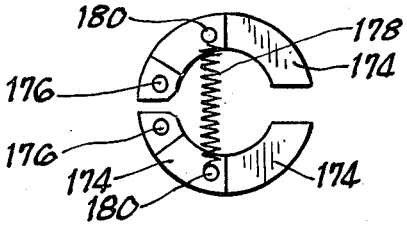
FIG. 14 is a plan view illustrating brake shoes utilized in association with the governor; and, FIG. 15 is a side elevation of a brake shoe.
Figure 15:
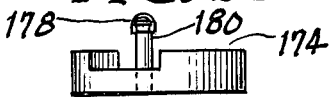

FIGS. 12 and 13 illustrate a brake hub 164 defining a threaded opening 165 for receiving a set screw whereby the hub can be fixed to one evoloid gear 88 as shown in FIGS. 5 and 7. A pair of pins 172 are press-fit into openings defined by the hub, and these pins pivotally support brake shoes 174 illustrated in FIGS. 14 and 15.

The brake shoes define openings 176 for receiving the pins 172. Additional pins 180 are press-fit into openings defined by the shoes 174, and these pins provide connections for the opposite ends of spring 178. This spring normally pivots these pins inwardly towards each other.

The drum 160 defines a flange 184 having openings 182 for attachment of the drum to the plate 42. This drum is, thus, received around the assembly of the brake hub and brake shoes.

As noted, the spring 178 normally pulls the shoes 174 away from contact with the liner 162. However, the centrifugal force which is developed in the shoes upon rotation of gear 88, drives the shoes into contact with the liner 162 to thereby limit the rotational speed of the system. In spite of the relatively small size of the speed governor, the mechanical advantage obtained because of the gear ratios involved insures highly effective speed control.

In the embodiment illustrated in solid lines, the crank arm 100 has a spring 126 attached to the pin 128 carried by each arm. The opposite end of this spring is attached to a post 130 located on the plate 30 whereby the arm 100 is normally urged into an engaging position with respect to one of the teeth 98 on the locking means 94. The associated solenoid 114 must be energized to move the crank arm 100 out of locking position.

The crank arm 102 has a spring 132 with one end connected to the pin 134 carried by the crank arm and the other end connected to a post 136 mounted on the plate 30. This results in holding of the arm 102 out of engaging position with respect to the teeth 98 of the locking means 92. A larger post 138 serves as a stop means for the arm 102, and it will be appreciated that when the associated solenoid 114 is energized, the arm 102 is moved into engaging position with respect to one of the teeth 98. A pair of switches 140 and 142 are included in a line connected to a power source for the respective solenoids.

The system includes means for disabling the locking of the turnstile whenever there is a power loss. In particular, a bolt 144 is pivotally mounted on the plate 30, and this bolt is attached to a rotatable shaft 146 which is normally held in the position illustrated. A spring 148 extends from the bolt to the pin 128 on the crank arm 100. In the case of a power loss, the bolt 144 is moved in the direction of the arrow whereby the spring 148 will overcome the spring 126 in which case the crank arm 100 is shifted to a non-engaging position. Under these conditions, the system is completely unlocked and individuals can pass through without depositing a fare. This insures movement of individuals will not be impeded by the turnstile.

A switch 150 is positioned adjacent the bolt 144, and the contact arm 152 of the switch is adapted to be engaged by the bolt. The switch 150 is then utilized for operating a light displayed through one of the windows 154 on the turnstile (FIG. 2) to indicate to individuals that the turnstile is unlocked and may be passed without the deposit of a fare.

The movement of bolt 144 can be controlled by a conventional lock arrangement. Thus, an attendant can be provided with a key for purposes of manually turning the bolt in an emergency situation or where the need should otherwise arise. It is also contemplated that the bolt will be held in the position shown in FIG. 5 by means of a solenoid, the solenoid being energized as long as power is available. In the event of power failure, the bolt will then automatically shift to a free-wheeling arrangement. The light display referred to can, of course, be operated by batteries or other supplemental power.

Figure 2:
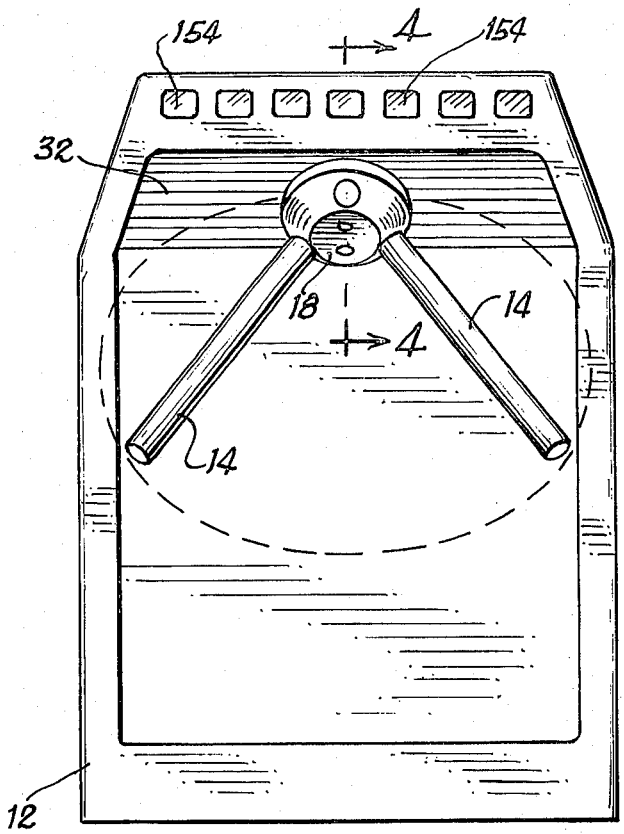
FIG. 2 is a front elevation of the construction.
Figure 3:
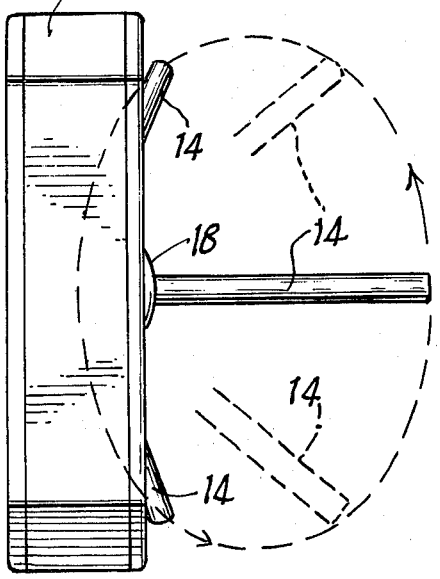
FIG. 3 is a plan view of the construction.

In the set-up of the construction illustrated, the turnstile is set for free-wheeling movement for persons moving from left to right in FIG. 2 whereas the turnstile is normaly locked with respect to movement of persons from right to left. FIGS. 5 and 7, which are views looking from the rear of the turnstile as shown in FIG. 2, thus illustrate the locking means 94 locked against clockwise movement which locks the drive gear 34 and head disc support 18 against clockwise movement. (As viewed from the front in FIG. 2, the disc support is thus locked against counterclockwise movement.)

When free-wheeling, the gear 34 moves counterclockwise, that is, opposite the direction of the arrow shown in FIGS. 5 and 7. The evoloid gears 88 also move counterclockwise under these conditions, and there is, of course, no resistance offered by the crank arm 102 which is out of engagement with the locking means 92. A tooth 98 will engage the end of the crank arm 100; however, the gear 88 is free to move even with the clutch cylindrical portion 95 held stationary. This clutch, of course, engages only when an attempt is made to rotate the associated evoloid gear in a clockwise direction, and the crank arm 100 prevents this.

In order to pass through the turnstile from right to left as shown in FIG. 2 (that is to move the gear 34 in a clockwise direction), an individual will normally deposit a fare, insert a card or ticket, or utilize some other authorized mode of entry. The display windows 154 positioned on the turnstile are preferably utilized for indicating the particular conditon of the turnstile. One of the windows thus may be designed for displaying a light which will turn on when the authorized entry condition has occurred. The development of this condition, for example, through an appropriate relay, will also serve to close switch 140 which pulls in the core of the solenoid 114 associated with crank arm 100. The locking means 94 is, therefore, free to rotate whereby the passenger can move against the blocking arm 14 and pass from right to left through the turnstile thereby rotating the gear 34 through 120°.

The movement of the control wheel 52 immediately operates to close switch 68, and the resulting signal may serve to change the light display on the turnstile to indicate that it is in use. This switch may also be employed for various circuit control operations which do not form a part of this invention.

After about 45° of movement of the wheel 52, the switch 60 opens, and this results in operation of the other solenoid 114. Specifically, the switch 60 may operate a relay connected to switch 142 whereby the other solenoid 114 wll move crank arm 102 into engaging position with respect to locking means 92. The clutch is engaged upon counterclockwise rotation and, therefore, the interposing of arm 102 prevents movement of the turnstile arms in the "free-wheeling" direction.

In a typical use of the apparatus, the locking means 92 is kept in the unlocked so that the turnstile will always be free for movement in a direction opposite the direction of movement requiring a fare deposit. This, in a transit operation, individuals will be required to deposit a fare when going in one direction but are free to exit from the other direction. The locking of the locking means 92 is provided for temporarily preventing this free movement in the other direction, therefore requiring an individual's movement in only one direction.

After about 180° of movement of the wheel 52, the switch 64 is operated, and this switch may be connected to a counter so that the frequency of turnstile use may be recorded. When the wheel 52 completes one revolution, the switch 68 is again opened. At this point, opening of the switch may result in a de-energizing of the relays holding in switches 140 and 142 so that the crank arms 100 and 102 will be returned to their original positions locking the turnstile against movement in one direction and permitting free wheeling of the turnstile in the opposite direction.

The illustrated arrangement may be modified to reverse the locked and free-wheeling directions of the turnstile. This is accomplished by shifting the brackets 117 in the manner previously described and repositioning the crank arms to the dotted line positions illustrated in FIG. 7. The roles of the springs 126 and 132 are then reversed whereby the crank arm 100 is held in the normally unlocked position, and the crank arm 102 is held in the normally locked position. The "15°" switch 60 is also repositioned when the direction of use is reversed and this is efficiently accomplished by the provision of alternate openings 156 formed in the plate 30. Thus, the switch 60 is merely moved from the position illustrated to the new location provided by the openings 156, and the arm 62 will then be positioned to engage the wheel 52 at a point 15° clockwise removed from the arm 70.

It will also be apparent that the turnstile structure is readily suited for locking in both directions by utilizing the solid position showing of FIG. 7 and shifting the end of the spring 132 from the link 110 to the pin 128 of crank arm 102. Simple circuit adjustments will then enable release of one locking means, depending upon which direction of movement is permitted by a fare deposit.

The described structure effectively avoids the above enumerated problems which characterize prior art operations. In connection with the possible damage which might occur when a sudden load is applied to the system, any break-away is effectively prevented. The gearing employed is particularly significant in this respect since the ratios involved enable the crank arms to resist extremely high loads thereby effectively locking the system against break-away under the severest loads which could be encountered in the day-to-day operation of the system. The crank arm design is also of significance since it will be noted that any load applied is transmitted along the axis of the long arm portion and is resisted by the mounting pin 122 of the crank arm. Accordingly, the solenoid cores are not forced inwardly when over-load forces are applied.

It will be noted that the turnstile arms cannot be pushed back and forth by a user when entry from one direction is being controlled. For example, if a user entering from the one direction pulls the blocking arm toward him for even a few degrees, he cannot push this arm back to the starting position. Assuming a set-up as shown in the drawings, the action in pulling the arm 14 forward in the free-wheeling direction will merely serve to rotate the gear 88 associated with locking means 94. The crank arm 100, however, remains in the blocking position so that one cannot push the arm back. This eliminates the problem wherein attempts to cheat the turnstile involve partial movement of the arm 14 forward and then return movement after an individual is given enough space to move in behind the arm 14.

It will be appreciated that various changes and modifications may be made in the above described construction which provide the characteristics of this invention without departing from the spirit thereof particularly as defined in the following claims.

That which is claimed is:

1. In a turnstile construction wherein arm means block the path of movement of persons passing the turnstile, said arm means being engaged by said persons and being movable out of a blocking position as the persons pass through the turnstile, and control means including locking and unlocking means for said arm means, the improvement in said control means comprising a drive gear tied to said arm means, first and second rotatable locking means operatively connected to said drive gear, first and second engaging means for said locking means, means normally holding at least one engaging means in engagement with a locking means, and means for disengaging said engaging means upon receipt of a fare by said construction, said engaging means comprising crank arms, spring means normally urging at least one of said crank arms into position for engagement with a locking means, a solenoid attached to said one crank arm, said solenoid operating in response to the receipt of a fare to disengage said one crank arm with respect to the locking means engaged thereby, and including electrical switch means, a rotatable switch actuator, means connecting said switch actuator to said drive gear, said switch actuator rotating during movement of said arm means, a switch actuatable by said actuator connected to said solenoid for operating said solenoid to return said one crank arm to engaging position after a person passing through the turnstile, a second solenoid, and an additional switch actuatable by said actuator, said additional switch, when actuated by said actuator, operating said second solenoid to cause said second solenoid to engage the other crank arm with the other locking means, said additional switch being positioned for operation by said switch actuator after partial movement of said arm means whereby said other locking means is engaged against movement during the balance of the movement of said arm means to permit movement of the arm means in only one direction.

2. A construction in accordance with claim 1 including alternative mounting means for said additional switch, whereby said switch can be mounted for operation by said switch actuator in either direction of rotation of the switch actuator.

3. In a turnstile construction wherein arm means block the path of movement of persons passing the turnstile, said arm means being engaged by said persons and being movable out of a blocking position as the persons pass through the turnstile, and control means including locking and unlocking means for said arm means, the improvement in said control means comprising a drive gear tied to said arm means, first and second rotatable, one-way clutch, locking means operatively connected to said drive gear whereby the locking means rotate in response to operation of the drive gear, first and second engaging means for said locking means, engaging of one locking means by the first engaging means causing the clutch mechanism of the one locking means to prevent rotation of the one locking means in a clockwise direction, and engaging of the second locking means by the second engaging means causing the clutch mechanism of the second locking means to prevent rotation of the second locking means is a counterclockwise direction, and means normally holding at least one engaging means in engagement with a locking means whereby the arm means is normally restrained against movement in one direction by the clutch mechanism of one locking means.

4. A construction in accordance with claim 3 wherein said engaging means comprise crank arms, and spring means normally urging at least one of said crank arms into position for engagement with a locking means.

5. A construction in accordance with claim 4 including a solenoid attached to said one crank arm, said solenoid operating one crank arm with respect to the locking means engaged thereby.

6. A construction in accordance with claim 5 including electrical switch means, a rotatable switch actuator, means connecting said switch actuator to said drive gear, said switch actuator rotating during movement of said arm means, and a switch connected to said solenoid for operating said solenoid to return said on crank arm to engaging position after a person passes through the turnstile.

7. A construction in accordance with claim 6 including at least one additional switch operatively associated with said switch actuator, a second solenoid adapted for operation by said additional switch, and a crank arm connected to said second solenoid whereby operation of said second switch is adapted to engage and disengage said crank arm with respect to a second rotatable locking means.

8. A construction in accordance with claim 7 including a third switch operatively associated with said switch actuator, and counter means connected to said third switch.

9. A construction in accordance with claim 3 including brake means associated with said locking means for maintaining the speed of rotation of said locking means at no greater than a maximum pre-determined speed.

10. A construction in accordance with claim 3 including electrically powered means for operating said engaging means, and means holding said engaging means out of engagement with a locking means in the absence of electrical power for said electrically powered means.

11. A construction in accordance with claim 3 wherein said first and second engaging means comprise crank arms, electrically powered means for moving said crank arms between first positions in engagement with a locking means and second positions out of engagement with a locking means.

12. A construction in accordance with claim 11 including means for supporting said electrically powered operating means and associated crank arms, and alternative mounting positions on said supporting means, said crank arms being adapted to hold said rotatable locking means against rotation in one direction when a first mounting position is employed, and in the opposite direction when a second mounting position is employed.

13. A construction in accordance with claim 5 including electrical switch means, a rotatable switch actuator, means connecting said switch actuator to said drive gear, said switch actuator rotating during movement of said arm means, a second solenoid, and an additional switch operatively associated with said switch actuator, said additional switch, when operated by said switch actuator, energizing said second solenoid to cause said second solenoid to engage the other

14. A construction in accordance with claim 4, including electrically powered means for moving said crank arms between first positions in engagement with a locking means and second positions out of engagement with a locking means.

15. A construction in accordance with claim 14 wherein a load applied to a turnstile arm is transmitted to at least one crank arm, said load being applied axially of one arm of the crank arm to thereby avoid the application of forces tending to pivot the crank arm upon application of a load.

16. A construction in accordance with claim 9 wherein said brake means comprises a stationary brake drum having a lining with a high coefficient of friction, and brake shoe members tied to said locking means whereby rotation of the locking means results in movement of the brake shoes toward said lining to thereby govern the speed of movement of said turnstile arm.

17. In a turnstile construction wherein arm means block the path of movement of persons passing the turnstile, said arm means being engaged by said persons and being movable out of a blocking position as the persons pass through the turnstile, and control means including locking and unlocking means for said arm means, the improvement in said control means comprising a drive gear tied to said arm means, first and second rotatable locking means operatively connected to said drive gear, first and second engaging means for said locking means, means normally holding at least one engaging means in engagement with a locking means, means for disengaging said engaging means upon receipt of a fare by said construction, a rotatable switch actuator, means connecting said switch actuator to said drive gear, said switch actuator rotating during movement of said arm means, and at least one switch actuatable upon rotation of said actuator.

18. A construction in accordance with claim 17 wherein said engaging means comprise crank arms, and spring means normally urging at least one of said crank arms into position for engagement with a locking means.

19. A construction in accordance with claim 18 including a solenoid attached to said one crank arm, said solenoid operating in response to the receipt of a fare to disengage said one crank arm with respect to the locking means engaged thereby.

20. A construction in accordance with claim 19 wherein said one switch is connected to said solenoid for operating said solenoid in opposition to said spring to return said one crank arm to engaging position after a person passes through the turnstile.

21. A construction in accordance with claim 20 including at least one additional switch actuatable by said switch actuator, a second solenoid adapted for operation by said additional switch, and a crank arm connected to said second solenoid whereby operation of said second switch is adapted to engage and disengage said crank arm with respect to a second rotatable locking means.

22. A construction in accordance with claim 21 including a third switch actuatable by said switch actuator, and counter means connected to said third switch.

23. In a turnstile construction wherein arm means block the path of movement of persons passing the turnstile, said arm means being engaged by said persons and being movable out of a blocking position as the persons pass through the turnstile, and control means including locking and unlocking means for said arm means, the improvement in said control means comprising a drive gear tied to said arm means, a rotatable locking means including a second gear connected thereto, said drive gear being operatively connected to said second gear, the ratios of the respective gears being such that the second gear revolves several times during one revolution of the drive gear, catch means carried by said locking means, and a locking arm movable into and out of engagement with said clutch means, a load applied by persons pressing against the turnstile arm means being resisted by said loading arm, and means operable under said load for shifting said locking arm out of engagement with said catch means.

24. A construction in accordance with claim 23 wherein said catch means comprise a plurality of teeth on said locking means, said locking arm comprising a crank arm, load applied to said turnstile arm being applied by said teeth axially of said crank arm, said means for shifting said locking arm comprising a solenoid for pivoting said crank arm.

25. A construction in accordance with claim 24 including a roller attached to the end of said crank arm for engagement with the teeth on said locking means.

26. A construction in accordance with claim 23 wherein said locking means comprises a one-way clutch, said catch means being associated with an outer race of said clutch and said second gear being associated with an inner shaft of the clutch which is non-rotatable in one direction relative to the outer race.

27. A construction in accordance with claim 26 wherein said drive gear and said second gear comprise the end gears of a gear train, said drive gear rotating 120° during the passage of one person through the turnstile, and each succeeding gear in the train having an increased number of revolutions relative to its preceding gear.

* * * * *

UNITED STATES PATENT OFFICE

CERTIFICATE OF CORRECTION

Patent No. 3,998,008 Dated December 21, 1976

Inventor(s) Terence J. Collins

It is certified that error appears in the above-identified patent and that said Letters Patent are hereby corrected as shown below:

Column 5, line 49, "provide unduly raid" should read --prevent unduly rapid--.

Column 7, line 63, --position-- appears after "unlocked".

Column 9, line 36, "passing" should read --passes--.

Column 10, line 22, "on" should read --one--.

Column 11, after line 2, the following is inserted: --crank arm, said additional switch being positioned for operation by said switch actuator after partial movement of said arm means whereby said second rotatable member is engaged against movement during the balance of the movement of said arm means to permit movement of the arm means in only one direction.--

Signed and Sealed this

Twenty-second Day of March 1977

[SEAL]

*Attest:*

RUTH C. MASON
*Attesting Officer*

C. MARSHALL DANN
*Commissioner of Patents and Trademarks*